United States Patent [19]

Müller

[11] Patent Number: 4,509,028

[45] Date of Patent: Apr. 2, 1985

[54] ELECTROMAGNETIC RELAY

[75] Inventor: Erwin Müller, Munich, Fed. Rep. of Germany

[73] Assignee: Siemens Aktiengesellschaft, Berlin & Munich, Fed. Rep. of Germany

[21] Appl. No.: 546,450

[22] Filed: Oct. 28, 1983

[30] Foreign Application Priority Data

Dec. 7, 1982 [DE] Fed. Rep. of Germany ... 8234360[U]

[51] Int. Cl.[3] ..... H01H 45/02

[52] U.S. Cl. ..... 335/202; 335/128; 335/203

[58] Field of Search ..... 335/128, 129, 202, 203, 335/274, 275

[56] References Cited

U.S. PATENT DOCUMENTS 3,486,142 12/1969 Little ..... 335/203

*Primary Examiner*—E. A. Goldberg
*Assistant Examiner*—George Andrews
*Attorney, Agent, or Firm*—Hill, Van Santen, Steadman & Simpson

[57] ABSTRACT

In an electromagnetic relay, a bridge contact arrangement whereby cooperating contact elements are disposed in one common plane lying next to one another. One of the cooperating contact elements angularly cantilevers over the free end of the other, shorter cooperating contact element with a cross-leg. In this manner the contact element can be provided with contact pieces aligned and properly spaced with one another. An armature-carried contact bridge spring serves to engage the contact pieces of the contact elements with equal contact pressure. The invention construction offers a simplified, reliable relay manufacture.

6 Claims, 3 Drawing Figures

ELECTROMAGNETIC RELAY

BACKGROUND OF THE INVENTION

The invention relates to an electromagnetic relay having a coil body support or carrier in which a contact spring is connected to the armature to engage into a contact pocket formed with the coil body and connects cooperating and aligned contact pieces in at least one switch position.

Electromagnetic relays are already standard for many uses. The making and/or breaking capacity is improved for high currents by means of employing bridge contacts. Previously known bridge contact arrangements, however, have the disadvantage that either the terminal pins of the contact elements are disposed too close to one another so that necessary insulating gaps are lacking or that one of the contact elements has to be bent in a complicated fashion for proper adjustment. By requiring this bending process to be undertaken, there exists the danger that the contact rivet or contact surfaces will be damaged and, thus, fault-free switching is no longer guaranteed.

In previous relay constructions, it is also possible to dispose the contact elements to be connected to the bridge contact spring behind one another in the longitudinal direction of the contact spring. In this manner, a sufficiently large spacing between the contact elements can be preselected and set. However, a significant drawback in such an arrangement is that the contact pressures on the two cooperating contact elements differ, which could have undesirable results.

An object of the present invention is to provide a contact relay construction having a bridge contact arrangement formed with the fewest and simplest parts possible, yet wherein the contact pressure at all contact locations is identical. The inventive really can be designed as a bridge closer, a bridge opener, and a bridge changeover without structural change by means of a corresponding employment of contact elements.

SUMMARY OF THE INVENTION

An electromagnetic relay has a coil body support comprising an angular yoke with a first leg coupled to a first pole end of a coil core and a second leg forming a bearing edge for a flat armature which forms a working air gap with the second pole end of the coil core. A contact spring is connected to the free end of the armature to extend into a contact pocket area formed on the coil body. The contact spring is formed with a contact bridge and has a bearing axis perpendicular to the base plane of the relay.

Two contact elements carrying the contact pieces cooperating with the contact bridge are designed as planar plates anchored in the coil body in a common plane. In accordance with the preferred embodiment, the first cooperating contact element exhibits a cross-leg at its free end lying in the common plane and extends toward and over the free end of the second cooperating contact element.

It is thus possible, as a result of the angular or hook-like shape of the first cooperating contact element, to dispose the two cooperating contact elements to be contacted in common by the spring's contact bridge behind one another in the longitudinal direction of the contact bridge, to provide the necessary, large spacing between contact elements, and to provide the contact locations of the two cooperating contact elements lying above one another so that both have the same spacing from the pivot axis of the bridge contact spring and, thus, receive the same contact pressure.

DESCRIPTION OF THE PREFERRED EMBODIMENT

Figure 1:
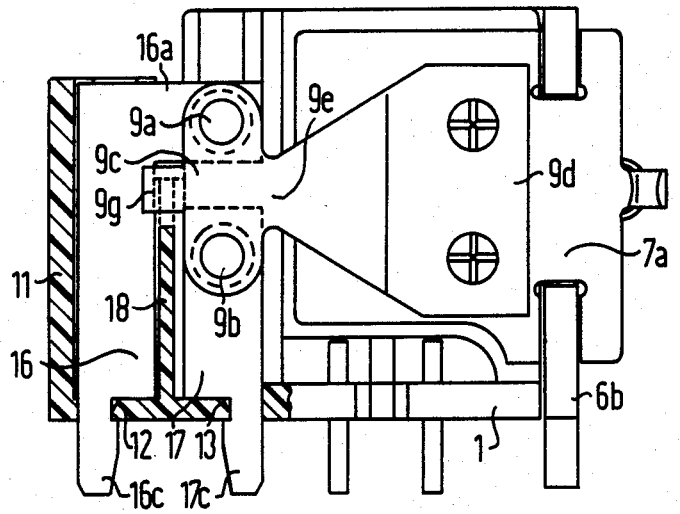
FIG. 1 is a front view of the inventive relay.
Figure 2:
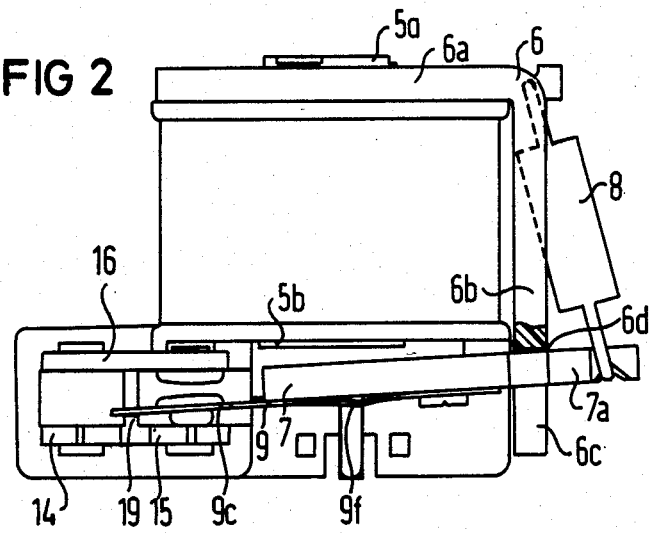
FIG. 2 is a plan view of FIG. 1.
Figure 3:
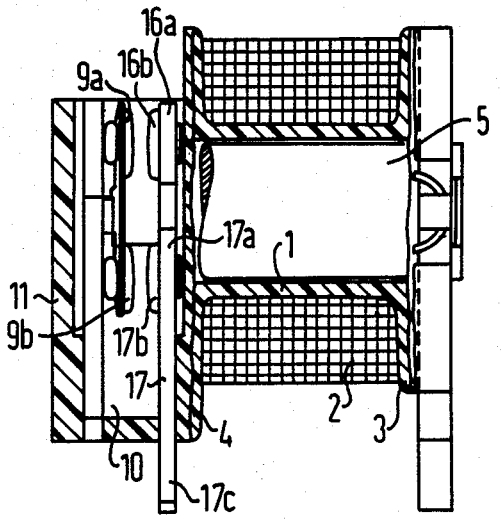
FIG. 3 is a cross-sectional view of FIG. 1.

With reference to FIGS. 1–3, an electromagnetic relay has a coil body 1 having a winding 2 which is disposed between flanges 3 and 4. An iron core 5 is disposed along the coil linear axis in the coil body 1. The iron core 5 has one end 5*a* connected to a first leg 6*a* of an angular yoke 6. The other end 5*b* of the core serves as a pole face and forms a working air gap with an armature 7 disposed with a projection 7*a* seated in a recess 6*c* of the second yoke leg 6*b* against a bearing edge 6*d*.

The armature 7 is drawn into its idle position by means of a restoring spring in the form of a helical spring 8. The armature is attracted against the force of the spring 8 to the core end 5*b* given response of the relay and thereby switches a torsional contact spring 9 secured to the free end of the armature.

The contact bridge spring 9 extends longitudinally of the armature into a contact pocket area 10. The contact pocket, as shown in FIG. 3, is formed by means of a projection 11 extending from the coil body flange 4. Four acceptance slots 12, 13, 14, and 15 for the acceptance of cooperating contacting elements are provided in the contact pocket.

In the illustrated embodiment, only the acceptance slots 12 and 13 are equipped with cooperating contact elements 16 and 17 whereas the opposite acceptance slots 14 and 15 remain unoccupied. The illustrated relay is thus designed as a bridge closer since the lower, idle side of the bridge contact spring 9 is not equipped with contact pieces. The acceptance slots 14 and 15 not employed in all embodiments are expediently closed by means of thin molded partitions which are only penetrated as needed by the inserted terminal spines of the cooperating contact elements when these acceptance slots are equipped. Of course, the acceptance slots 14 and 15 can also be provided with cooperating contact elements which would form a break contact with the contact spring 9 so that the relay would be designed overall as a bridge changeover.

At its free end 17*a*, a relatively short and linearly directed cooperating contact element 17 carries a contact rivet 17*b*. A relatively longer, angularly directed contact element 16 is formed with a cross-leg 16*a* at its free end which cantilevers over the free end 17*a* of the other contact element and carries a contact rivet 16*b* in the area directly above the second cooperating contact element 17. The two cooperating contact elements 16 and 17 lie entirely in one common plane. The two contact rivets 16*b* and 17*b* exhibit the same spacing relative to the axis of pivot of the contact bridge spring 9 so that both contact rivets 16*b* and 17*b* simultaneously come into contact with contact rivets 9*a* and 9*b* of the contact bridge piece 9*c* when the armature 7 is attracted and are charged with the same contact pressure by means of the torsional contact spring 9.

Connector spines 16*c* and 17*c* of the cooperating contact elements 16 and 17, respectively, are designed such that they exhibit as great as possible a spacing relative to one another. In order to increase the insulating strength between the cooperating contact elements and in order to improve the rigid strength of the contact pocket body, a transversely extending partition wall 18 is provided in the contact pocket body between the base ends of the contact elements.

The contact spring 9 need conduct the switched current only with its bridge contact piece 9*c* at the free end thereof. Hence, under given conditions, the spring 9 can also be secured insulated to the armature 7. In the area between the contact bridge piece 9*c* and the spring's fastened end 9*d*, the spring 9 has a stay arm 9*e* reduced in cross-section by means of notches whose width is less than the spacing between the contact rivets 9*a* and 9*b*. This narrow stay arm thus affords a torsion over which different contact openings of the upper and lower contact can be compensated in order to obtain equal contact forces. In the area between the fastened end 9*d* and the stay 9*e*, the contact spring has a trapezoidal section for improving elastic flexure. A prestress transverse kink 9*f* is also provided in the trapezoidal section to increase the contact forces and prevent a burn-up.

In order to prevent arcing given high switched voltages, the contact spring 9 is rounded at the outer edges in the area of the contact bridge piece 9*c*. It also exhibits a projecting tab 9*g* at its free end which strikes against a stop boss 19, as shown in FIG. 2, to fix the idle position of the armature. The tab 9*g* can be cut off when the acceptance slots 14 and 15 are provided with cooperating contact elements, i.e., given an opener or changeover use of the relay.

Although various minor modifications may be suggested by those versed in the art, it should be understood that I wish to embody within the scope of the patent warranted hereon all such modifications as reasonably and properly come within the scope of my contribution to the art.

I claim as my invention:

1. An electromagnetic relay comprising a coil body carrier supported by an angular yoke having a first leg coupled to one pole end of a coil core and a second leg forming a bearing edge for a flat armature facing across a working gap with the other pole end of the coil core, a contact spring connected to said armature and extending longitudinally thereof, said contact spring having a transverse contact bridge portion outward from said armature for engaging at least one pair of cooperating contact pieces aligned with one another in one switch position, the improvement comprising at least one pair of contact elements in the form of side-by-side planar plates mounted in said carrier to extend together in a common plane, the first contact element free end having a cross-leg directed over the free end of the second contact element so as to extend across the linear axis of the second contact element, and the free ends of the first contact element cross-leg and the second contact element having said at least one pair of cooperating contact pieces respectively mounted thereon.

2. The electromagnetic relay of claim 1, further comprising a contact pocket body disposed on said coil body carrier for receiving therein said contact bridge portion and said contact elements, said pocket body having respective pairs of acceptance openings for receiving two pairs of contact elements therethrough wherein said pairs are disposed respectively above and below said contact spring for movement of said contact bridge portion between them.

3. The electromagnetic relay of claim 2, further comprising a partition mounted in said contact pocket body between the side-by-side planar plates of each said contact element pair.

4. The electromagnetic relay of claim 1, wherein the free end of said contact spring has a tab portion for engaging against a stop means to define the idle position of said armature.

5. The electromagnetic relay of claim 1, wherein said contact spring has a trapezoidal-shaped plan profile area between said contact bridge portion and an end section fastened to said armature, the smaller end of said plan profile area facing said contact bridge section.

6. The electromagnetic relay of claim 1, wherein said contact spring has a torsion arm section between said contact bridge portion and an end section fastened to said armature, said torsion arm section having a width less than the width-wise spacing between the said pair of contact pieces respectively mounted on said first and second contact elements.

* * * * *